US007090543B2

(12) United States Patent
Lee et al.

(10) Patent No.: US 7,090,543 B2
(45) Date of Patent: Aug. 15, 2006

(54) WIRE HARNESS CONNECTOR

(75) Inventors: Cheol-Seob Lee, Daegu (KR); Dae-Gyu Kim, Siheung-Si (KR)

(73) Assignee: Tyco Electronics AMP Korea Ltd, Kyungsangbuk-Do (KR)

( * ) Notice: Subject to any disclaimer, the term of this patent is extended or adjusted under 35 U.S.C. 154(b) by 0 days.

(21) Appl. No.: 11/271,183

(22) Filed: Nov. 10, 2005

(65) Prior Publication Data

US 2006/0110989 A1 May 25, 2006

(30) Foreign Application Priority Data

Nov. 12, 2004 (KR) ..... 10-2004-0092423

(51) Int. Cl.
*H01R 13/514* (2006.01)

(52) U.S. Cl. ..... 439/752; 439/489

(58) Field of Classification Search ..... 439/489, 439/752

See application file for complete search history.

(56) References Cited

U.S. PATENT DOCUMENTS 5,203,722 A 4/1993 Kinoshita
5,928,038 A * 7/1999 Berg et al. ..... 439/752
6,491,542 B1 * 12/2002 Zerebilov ..... 439/489
2004/0087206 A1 * 5/2004 Grubbs ..... 439/489

* cited by examiner

*Primary Examiner*—Tho D. Ta
(74) *Attorney, Agent, or Firm*—Barley Snyder LLC

(57) ABSTRACT

A wire harness connector in which at least one guide, the upper surface of which is inclined such that the upper surface becomes higher from the front end of the guide to the rear end of the guide, is formed on the side surface of a central portion of a locking member, and at least one sliding wall for gradually pressing the guide as the interconnection between a plug housing and a cap housing progresses is formed on the cap housing at a position corresponding to the position of the guide. Even when the locking member is not completely assembled with the plug housing due to worker carelessness, the cap housing is easily connected to the locking member by the sliding of the guide along the sliding wall, and the locking member is seated in the plug housing at a correct position simultaneously with the connection so that the secondary fixation of terminals by the locking member is completely performed.

6 Claims, 4 Drawing Sheets

PRIOR ART

WIRE HARNESS CONNECTOR

FIELD OF THE INVENTION

The present invention relates to an electrical connector, and more particularly to a wire harness connector, in which a locking member for secondarily fixing terminals located in a plug housing is assembled with the plug housing at a correct position when the plug housing and a cap housing are interconnected.

BACKGROUND OF THE INVENTION

Generally, when plural devices are connected to a controller or a relay and fuse box, a wire harness comprising a plurality of electric wires is used so that the electric wires are easily managed. Ends of both wire harnesses are connected to devices using connectors.

Connection pins are connected to electric wires of one wire harness, and are stored in a cap housing, and terminals having shapes for receiving the connection pins inserted thereinto are connected to electric wires of the other wire harness, and are stored in a plug housing. Then, the plug housing and the cap housing are interconnected so that the connection pins are inserted into the terminals, thereby electrically interconnecting both wire harnesses.

FIG. 1 illustrates a plug housing and a locking member of a conventional wire harness connector.

A plurality of terminal insertion holes 110 are formed through the plug housing 100 so that terminals are inserted into the rear portions of corresponding terminal insertion holes 110.

An opening 120 is formed through the lower surface of the plug housing 100 so that the locking member 200 is inserted into the opening 120.

When the locking member 200 is inserted into the opening 120, the locking member 200 is firstly inserted to a proper position such that an upper plate 210 and a lower plate 220 of the locking member 200 do not interfere with the terminals inserted into the terminal insertion holes 110, and then the terminals are inserted into the rear portions of the terminal insertion holes 110.

Latching holes are respectively formed in the upper inner walls of the terminal insertion holes 110 so that latching protrusions formed on the terminals are latched onto the latching holes. Thereby, the first fixation of the terminals is performed by inserting the terminals into the terminal insertion holes 110.

When the locking member 200 is completely inserted into the opening 120 under the above condition that the terminals are first fixed, latching protrusions formed on the upper and lower plates 210 and 220 of the locking member 200 are latched onto latching holes formed in the lower portions of the terminals, thereby performing the second fixation of the terminals. Accordingly, the stable fixed state of the terminals is maintained.

When a cap housing (not shown) is connected to the front surface of the above-assembled plug housing 100 in the direction of the arrow, connection pins installed in the cap housing reach the front portions of the terminal insertion holes 110, and are inserted and connected into the terminals inserted into the terminal insertion holes 110. Thereby, the cap housing is electrically connected to the plug housing 100.

When the locking member 200 is assembled with the plug housing 100, the locking member 200 must be inserted into the opening 120 in a specific direction. That is, since a position determination groove 230 is formed in the locking member 200 and a position determination protrusion 130 is formed on a corresponding corner of the opening 120 of the plus housing 100, the locking member 200 can be assembled with the plug housing 100 only in a correct direction. Further, the fixation of the terminals is undesirably carried out by two steps before and after the insertion of the terminals. Accordingly, even when the fixation of the terminals (i.e., the second fixation step of the terminals) is not completely carried out, the assembly of the wire harness connector may be terminated.

In this case, the fixed state of the terminals is not stable, and, when the plug housing 100 and the cap housing are interconnected, the cap housing is caught by the locking member 200, thereby disturbing the connection of the connector.

SUMMARY OF THE INVENTION

Therefore, the present invention has been made in view of the above problems, and it is an object of the present invention to provide a wire harness connector, in which a locking member moves to a complete insertion position of a plug housing by a cap housing, even when the secondary insertion of the locking member is not completely carried out, so that the plug housing and the cap housing are easily interconnected and secondary fixation of terminals is completely performed.

In accordance with the present invention, the above and other objects can be accomplished by the provision of a wire harness connector. A plug housing of the connector has a plurality of terminal insertion holes horizontally passing through the body thereof and an opening vertically formed in the central portion of the body thereof. A locking member is inserted into the opening for fixing terminals inserted into the terminal insertion holes. A cap housing has connection pins inserted into and connected to the terminals, and receives the plug housing so as to be connected to the plug housing under the condition that the locking member is inserted into the opening. A front opening portion and a rear opening portion are respectively extended forwards and backwards from the central portion of the opening of the plug housing. An elastic central portion formed integrally with the locking member is seated in the front and rear opening portions so as to interconnect the plug housing and the cap housing. At least one guide, the upper surface of which is inclined such that the upper surface becomes higher from the front end of the guide to the rear end of the guide, is formed on the side surface of the central portion. At least one sliding wall sliding along the upper surface of the guide is formed on the upper inner wall of the cap housing.

BRIEF DESCRIPTION OF THE DRAWINGS

The present invention will be more clearly understood from the following detailed description taken in conjunction with the accompanying drawings, in which.

DETAILED DESCRIPTION OF THE EMBODIMENTS

Now, an embodiment of the present invention will be described in detail with reference to the drawings.

Figure 1:
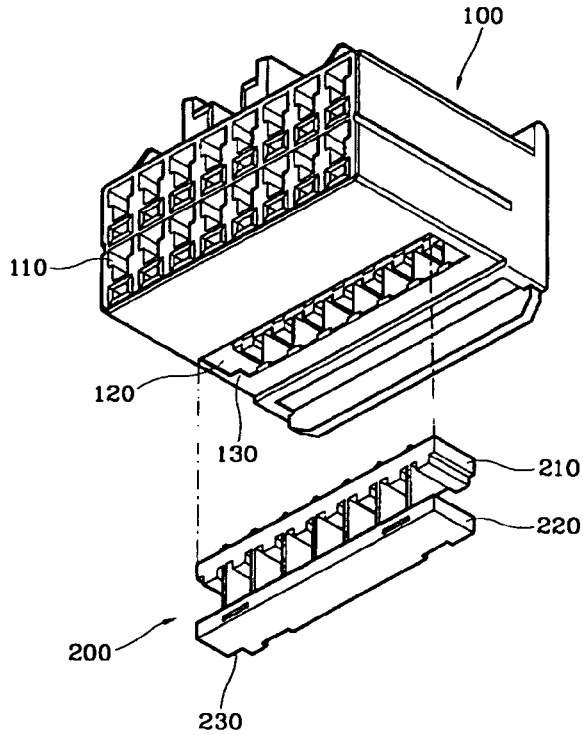
FIG. 1 is a perspective view illustrating a plug housing and a locking member of a conventional wire harness connector.
Figure 2:
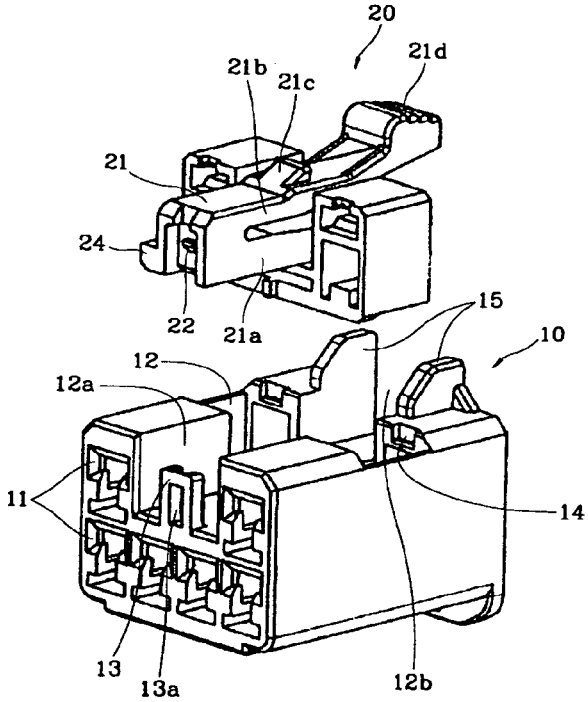
FIG. 2 is a front perspective view illustrating a plug housing and a locking member of a wire harness connector in accordance with the present invention.
Figure 3:
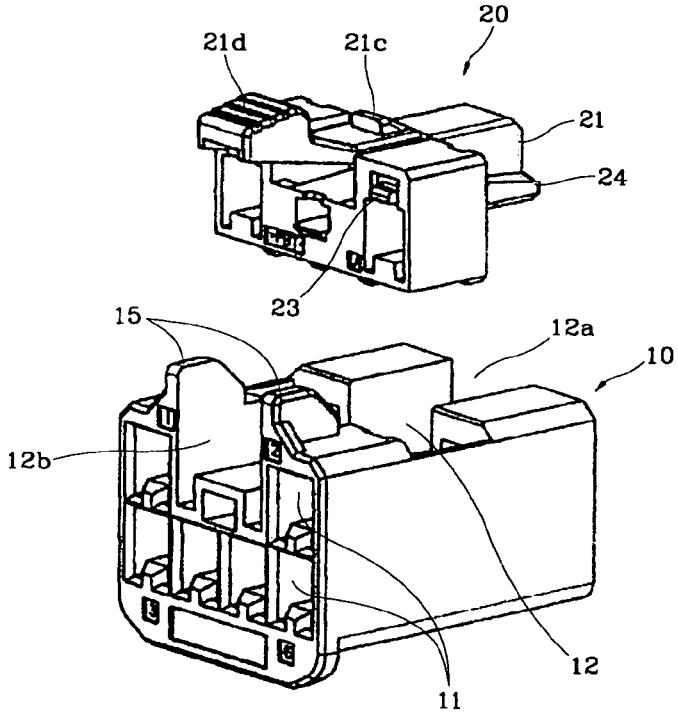
FIG. 3 is a rear perspective view illustrating the plug housing and the locking member of the wire harness connector shown in FIG. 2.

FIG. 2 is a front perspective view illustrating a plug housing and a locking member of a wire harness connector in accordance with the present invention, and FIG. 3 is a rear perspective view illustrating the plug housing and the locking member of the wire harness connector shown in FIG. 2. Although terminals and a cap housing are not shown in the drawings, as shown in the arrows, the terminals are inserted into the rear surface of the plug housing 10, and the cap housing moves towards the front surface of the housing 10 and covers the plug housing 10.

A plurality of terminal insertion holes 11 are horizontally formed through a body of the plug housing 10, and are arranged in a lattice shape.

A vertical opening 12 is formed through the upper surface of the body of the plug housing 10 such that the opening 12 is orthogonal to the terminal insertion holes 11.

In the same manner as the conventional wire harness connector, the opening 12 is formed throughout the upper surface of the body of the plug housing 10 in the longitudinal direction so that both side bodies of the locking member 20 are inserted into the opening 12. The opening 12 comprises a front opening portion 12*a* and a rear opening portion 12*b*, which are respectively extended forwards and backwards from the central portion of the opening 12. The terminal insertion holes 11 are arranged in two lines, and the front opening portion 12*a* and the rear opening portion 12*b* have the same depth as that of the terminal insertion holes 11 in the upper line so that front and rear parts of a central portion 21 formed between both side bodies of the locking member 20, which will be described later, are inserted into the front opening portion 12*a* and the rear opening portion 12*b*.

That is, the opening 12 having a cross shape crosses the body of the plug housing 10 in lengthwise and crosswise directions. The crosswise portion of the opening 12 has a depth equal to the overall depth of the body of the plug housing 10, and the lengthwise portion of the opening 12 has a depth corresponding to the depth of the terminal insertion holes 11 in the upper line.

The locking member 20 has a shape corresponding to the opening 12 so that the locking member 20 is fitted into the opening 12.

The locking member 20 has side bodies having rectangular hexahedral shapes formed at both sides of a base portion, and the central portion 21 made of an elastic body and interposed between both side bodies such that the central portion 21 is separated from the side bodies by a designated interval so as to maintain the interconnection between the plug housing 10 and a cap housing 30. Here, the central portion 21 is orthogonal to the side bodies.

The side bodies including the base portion of the locking member 20 are inserted into the opening 12 in the crosswise direction, and the central portion 21 of the locking member 20 is inserted into the opening 12 in the lengthwise direction, i.e., the central portion 21 is inserted into the front and rear opening portions 12*a* and 12*b*.

In order to connect the locking member 20 to the plug housing 10, a latching protrusion 22 is formed on the front surface of the central portion 21 of the locking member 20, and a latching piece 13 provided with a rectangular hole 13*a* is protruded from the front end of the front opening portion 12*a* of the plug housing 10 so that the latching protrusion 22 is inserted into the hole 13*a* of the latching piece 13.

Fixing protrusions 23, which are pressed by applying external force thereto and are biased out by eliminating the external force therefrom, are respectively formed on the rear surfaces of the side bodies of the locking member 20, and fixing holes 14 corresponding to the fixing protrusions 23 are formed in the rear wall of the opening 12. Accordingly, when the locking member 20 is firstly inserted into the opening 12, the fixing protrusions 23 are seated in the fixing holes 14, and then when the locking member 20 is completely (secondarily) inserted into the opening 12, the fixing protrusions 23 pass over the fixing holes 14 and are latched onto the upper surfaces of the terminal insertion holes 11 of the plug housing 10, thereby completely fixing the locking member 20 to the plug housing 10.

Figure 4:
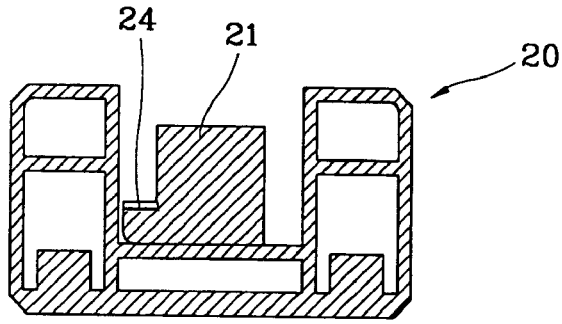
FIG. 4 is a schematic sectional view of the locking member.
Figure 5:
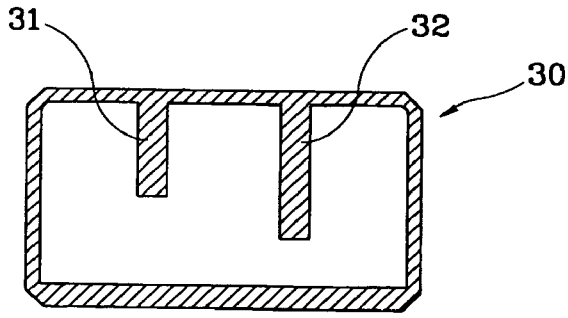
FIG. 5 is a schematic sectional view of a cap housing.

As shown in FIG. 4, a guide 24 having a designated height is formed on one side surface of the central portion 21 of the locking member 20, and, as shown in FIG. 5, a sliding wall 31 having a designated length approaching the guide 24 is extended downwards from the upper surface of the cap housing 30.

That is, the height of the guide 24 is varied, and the length of the sliding wall 31 is determined according to variation in the height of the guide 24.

The height of the guide 24 means the height of the cross section of the front portion of the guide 24, and the upper surface of the guide 24 is inclined such that the upper surface of the guide 24 is gradually higher from the front end of the plug housing 10 to the rear end of the plug housing 10.

Thus, the sliding wall 31 has a length such that the sliding wall 31 approaches the upper surface of the front end of the guide 24. Thereby, when the cap housing 30 is connected to the plug housing 10, the sliding wall 31 can be inserted into a space between both side bodies and the central portion 21 of the locking member 20, and, when the connection between the cap housing 30 and the plug housing 10 is completed, the guide 24 is strongly pressed by the sliding wall 31.

Since there are spaces between both side bodies and the central portion 21 of the locking member 20, the guide 24 may be formed on both side surfaces of the central portion 21 of the locking member 20. Further, the two guides 24 formed on both side surfaces of the central portion 21 of the locking member 20 may have different heights. In this case, two sliding walls 31 and 32 having different lengths proper to the heights of the corresponding guides 24 are formed on the cap housing 30.

The central portion 21 of the locking member 20 is an elastic piece having an approximately C shape.

That is, the central portion 21 of the locking member 20 comprises a lower body 21*a* formed integrally with the base portion of the locking member 20, and an upper body 21*b* bent from the lower body 21*a* in a C shape and elastically rotated against the lower body 21*a*.

A protrusion 21*c*, the front surface of which is inclined, is formed on the central area of the upper surface of the upper body 21*b*. The inclined front surface of the protrusion 21*c* is gradually higher from the front end thereof to the rear end thereof.

The rear end of the upper body 21*b* is bent upwards, and a press plate 21*d* for allowing a user to press it by finger is formed on the upper surface of the bent rear end of the upper body 21*b*.

A latching groove (not shown) corresponding to the protrusion 21*c* of the upper body 21*b* is formed in the upper wall of the cap housing 30 so that the protrusion 21*c* is inserted into the latching groove.

Hereinafter, the function and effects of the wire harness connector of the present invention will be described.

A worker inserts the locking member 20 into the opening 12 up to a first insertion position, and inserts terminals having wires connected to the rear ends thereof into the terminal insertion holes 11 from the rear surface of the plug housing 10.

By the above first insertion of the locking member 20, latching protrusions formed on the upper portions of the terminals are latched onto latching holes formed in the upper inner walls of the terminal insertion holes 11 in the same manner as the conventional wire harness connector, thereby performing the first fixation of the terminals. Here, the fixing protrusions 23 formed on the rear surfaces of the side bodies of the locking member 20 are seated in the fixing holes 14 formed through the rear surface of the opening 12 of the plug housing 10.

Thereafter, the locking member 20 is urged so as to perform the second fixation of the locking member 20. Here, the latching protrusion 22 of the central portion 21 of the locking member 20 is inserted into the hole 13*a* formed through the latching piece 13 of the plug housing 10, and the fixing protrusions 23 pass over the fixing holes 14 and are latched onto the upper surfaces of the terminal insertion holes 11 of the plug housing 10.

Accordingly, in the same manner as the conventional wire harness connector, latching protrusions formed on the locking member 20 are inserted into latching holes formed in the terminals, thereby completely fixing the terminals.

Even when the locking member 20 is not completely assembled with the plug housing 10, the locking member 20 can be completely assembled with the plug housing 10 by connecting the cap housing 30 to the plug housing 10. Thereby, the second fixation of the terminals to the plug housing 10 by the locking member 20 is completely performed.

The above fixation is performed by the guide 24 formed on the locking member 20 and the sliding wall 31 formed on the cap housing 30.

That is, when the plug housing 10 and the cap housing 30 approach each other under the condition that the plug housing 10 and the cap housing 30 face each other and the plug housing 10 is received in the cap housing 30, the sliding wall 31 moves towards the upper surface of the guide 24. At this time, in the case that a cap housing, which is not matched with the plug housing 10, is connected to the plug housing 10, the sliding wall 31 of the cap housing 30 is caught by the guide 24, thus preventing the assembly of the cap housing 30 with the plug housing 10.

When the connection between the cap housing 30 and the plug housing 10 is further advanced, the sliding wall 31 contacts the upper surface of the guide 24 and slides along the upper surface of the guide 24. That is, the sliding wall 31 ascends along the inclined upper surface of the guide 24, gradually presses the guide 24, and thus strongly presses the guide 24 at the final assembly position.

Accordingly, even when the locking member 20 is not completely inserted into the opening 12, the pressing of the guide 24 by the sliding wall 31 causes the locking member 20 to be completely inserted into the opening 12, thereby firmly assembling the locking member 20 with the plug housing 10. Thus, the second fixation of the terminals by the locking member 20 is firmly completed.

When the plug housing 10 enters into the cap housing 30, the protrusion 21*c* is pressed by the upper wall of the cap housing 30, and thus the upper body 21*b* is rotated downwardly. Thereafter, when the entering of the plug housing 10 into the cap housing 30 is completed, the protrusion 21*c* is inserted into the latching groove formed in the cap housing 30, thereby firmly maintaining the connection between the plug housing 10 and the cap housing 30.

In the above connected state, the press plate 21*b* is located between protection plates 15 formed at both sides of the plug housing 10. Since the press plate 21*b* is not pressed by external force under the above state, it is possible to prevent the plug housing 10 and the cap housing 30 from being undesirably separated from each other.

On the other hand, in order to separate the plug housing 10 and the cap housing 30 from each other, the press plate 21*b* is pressed so that the protrusion 21*c* is released from the latching groove, and then the plug housing 10 is taken out of the cap housing 30.

The latching protrusion 22 of the central portion 21 of the locking member 20 is inserted into the hole 13*a* of the latching piece 13 of the plug housing 10, thereby preventing the central portion 21 from coming undone from the plug housing 10 when the press plate 21*d* is pressed so as to separate the plug housing 10 and the cap housing 30 from each other.

As apparent from the above description, the present invention provides a wire harness connector, in which a plug housing and a cap housing are easily assembled, even when a locking member is not completely assembled with the plug housing due to worker carelessness.

Further, in the wire harness connector, the locking member is completely assembled with the plug housing by the connection between the plug housing and the cap housing, thereby also completely performing the second fixation of terminals.

By the above structure of the wire harness connector, the locking member is firmly seated in the plug housing, the cap housing is easily connected to the plug housing under the condition that the locking member is seated in the plug housing, and, even when the seated state of the locking member is not stable, the locking member is completely seated in the plug housing by the connection between the plug housing and the cap housing so that the plug housing and the cap housing are easily interconnected and secondary fixation of terminals by the locking member is completely performed.

Although an embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A wire harness connector comprising:

a plug housing having a plurality of terminal insertion holes horizontally passing through the body thereof and an opening vertically formed in the central portion of the body thereof;

a locking member inserted into the opening for fixing terminals inserted into the terminal insertion holes; and a cap housing having connection pins inserted into and connected to the terminals, and receiving the plug housing so as to be connected to the plug housing under the condition that the locking member is inserted into the opening, wherein a front opening portion and a rear opening portion respectively extend forwards and backwards from the central portion of the opening of the plug housing, an elastic central portion formed integrally with the locking member is seated in the front and rear opening portions so as to interconnect the plug housing and the cap housing, at least one guide, the upper surface of which is inclined such that the upper surface becomes higher from the front end of the guide to the rear end of the guide, is formed on the side surface of the elastic central portion, and at least one sliding wall sliding along the upper surface of the guide is formed on the upper inner wall of the cap housing.

2. The wire harness connector as set forth in claim 1, wherein:

the central portion of the locking member comprises a lower body formed integrally with a base portion of the locking member, and an upper body bent from the lower body in a C shape and elastically rotated against the lower body; and a protrusion, the front surface of which is inclined, is formed on the upper surface of the upper body, the rear end of the upper body is bent upwards, and a press plate is formed on the bent rear end of the upper body.

3. The wire harness connector as set forth in claim 1, wherein two guides having a designated height are formed at both sides of the central portion, and two sliding walls having a length corresponding to the height of the guides are formed on the upper inner wall of the cap housing at positions corresponding to the positions of the guides.

4. The wire harness connector as set forth in claim 1, wherein fixing protrusions, which are elastically pressed and biased out, are formed on the rear surfaces of both side bodies of the locking member, fixing holes are formed in the rear surface of the opening at positions corresponding to the positions of the fixing protrusions, and, when the locking member is completely inserted into the opening, the fixing protrusions pass over the fixing holes and are latched onto the upper surfaces of the terminal insertion holes of the plug housing.

5. The wire harness connector as set forth in claim 1, wherein a latching protrusion is formed on the front surface of the central portion of the locking member, and a latching piece provided with a rectangular hole is protruded from the front end of the front opening portion of the plug housing so that the latching protrusion is inserted into the rectangular hole.

6. The wire harness connector as set forth in claim 1, wherein protection plates having a height corresponding to the height of the press plate are formed on upper surfaces of both sides of the rear opening portion of the plug housing.

* * * * *